US010464351B2

(12) United States Patent
Kunioka

(10) Patent No.: US 10,464,351 B2
(45) Date of Patent: Nov. 5, 2019

(54) PRINTER, METHOD OF PRINTING, AND IMAGE APPLYING APPARATUS

(71) Applicant: Satoshi Kunioka, Kanagawa (JP)

(72) Inventor: Satoshi Kunioka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/977,376

(22) Filed: May 11, 2018

(65) Prior Publication Data

US 2018/0345691 A1 Dec. 6, 2018

(30) Foreign Application Priority Data

Jun. 6, 2017 (JP) ..... 2017-111462
Mar. 5, 2018 (JP) ..... 2018-039093

(51) Int. Cl.

| | |
|---|---|
| ***B41J 13/00*** | (2006.01) |
| ***B41J 2/01*** | (2006.01) |
| ***B41J 3/407*** | (2006.01) |
| ***B41F 17/38*** | (2006.01) |
| ***B41J 11/00*** | (2006.01) |
| ***D06P 5/30*** | (2006.01) |

(52) U.S. Cl.

CPC ..... *B41J 13/0009* (2013.01); *B41F 17/38* (2013.01); *B41J 2/01* (2013.01); *B41J 3/4078* (2013.01); *B41J 11/002* (2013.01); *D06P 5/30* (2013.01)

(58) Field of Classification Search

CPC ..... B41J 13/0009; B41J 2/01; B41J 3/4078; B41J 11/002; B41F 17/38; D06P 5/30

See application file for complete search history.

(56) References Cited

U.S. PATENT DOCUMENTS

2002/0071701 A1* 6/2002 Sullivan ..... B41J 11/002 399/365
2017/0036459 A1* 2/2017 Ohara ..... B41J 11/002
2018/0147858 A1 5/2018 Kunioka

FOREIGN PATENT DOCUMENTS

JP 2005-324559 11/2005
JP 2014-4707 1/2014

* cited by examiner

*Primary Examiner* — Lamson D Nguyen
(74) *Attorney, Agent, or Firm* — Oblon, McClelland, Maier & Neustadt, L.L.P.

(57) ABSTRACT

A printer includes a printing mechanism configured to print on a printing object held by a holder, a reciprocating mechanism configured to move the holder in a first direction and a second direction opposite to the first direction, and controller circuitry configured to control the printing mechanism and the reciprocating mechanism. When the controller circuitry executes a superimposed printing on the printing object, the controller circuitry causes the printing mechanism to execute a pre-printing process and a post-printing process that prints on the image printed by the pre-printing process while the holder is moved in the first direction from a waiting position, and the controller circuitry causes the reciprocating mechanism to stop a movement of the holder for a predetermined time period after the pre-printing process is terminated and the holder has returned to the waiting position.

12 Claims, 16 Drawing Sheets

PRINTER, METHOD OF PRINTING, AND IMAGE APPLYING APPARATUS

CROSS-REFERENCE TO RELATED APPLICATIONS

This patent application is based on and claims priority pursuant to 35 U.S.C. § 119(a) to Japanese Patent Application Nos. 2017-111462, filed on Jun. 6, 2017, and 2018-039093, filed on Mar. 5, 2018, in the Japan Patent Office, the entire contents of which are incorporated herein by reference.

BACKGROUND

Technical Field

Embodiments of the present disclosure relate to a printer, a method of printing, and an image applying apparatus.

Related Art

In the past, a known printer includes a set-tray on which a medium is placed, a recording unit to record on the medium placed on the set-tray, and a moving mechanism to move the set-tray in a first direction relative to the recording unit. The known printer records an undercoat on the medium while the set-tray is moved in the first direction. After recording the undercoat, the known printer moves the set-tray to a waiting position. After the set-tray returns to the waiting position, the known printer executes a superimposed recording on the medium while the set-tray is moved in the first direction.

SUMMARY

A first aspect of the present disclosure provides a novel printer. The printer includes a printing mechanism configured to print on a printing object held by a holder, a reciprocating mechanism configured to move the holder in a first direction and a second direction opposite to the first direction, and controller circuitry configured to control the printing mechanism and the reciprocating mechanism. When the controller circuitry executes a superimposed printing on the printing object, the controller is configured to cause the printing mechanism to execute a pre-printing process and a post-printing process, which prints on an image printed by the pre-printing process, while the holder is moved in the first direction from a waiting position, and to cause the reciprocating mechanism to stop movement of the holder for a predetermined time period after the pre-printing process is terminated and the holder has returned to the waiting position.

A second aspect of the present disclosure provides a novel image applying apparatus. The image applying apparatus includes the printer described in the first aspect of the present disclosure, a holder configured to hold the cloth and a heating device configured to heat the cloth. The holder is used by both the printer and the heating device with the cloth held on the holder.

A third aspect of the present disclosure provides a novel printer. The printer includes a printing mechanism configured to print on a printing object held by a holder, a reciprocating mechanism configured to move the holder in a first direction and a second direction opposite to the first direction, and a controller circuitry configured to control the printing mechanism and the reciprocating mechanism. When the controller circuitry executes a superimposed printing on the printing object, the controller circuitry is configured to cause the printing mechanism to execute a pre-printing process while the holder is moved in the first direction from a waiting position, and to cause the printing mechanism to execute a post-printing process that prints on an image printed by the pre-printing process while the holder is moved in the second direction to the waiting position.

A fourth aspect of the present disclosure provides a novel image applying apparatus. The image applying apparatus includes printer described in the first aspect of the present disclosure, a holder configured to hold the cloth and a heating device configured to heat the cloth. The holder is used by both the printer and the heating device with the cloth held on the holder.

A fifth aspect of the present disclosure provides a novel method of printing. The method of printing includes the following steps. Attaching a holder holding a printing object to a receiver in a printer, and executing a pre-printing process while the receiver is moved to an attaching-detaching position in which the holder is attached to the receiver or detached from the receiver, after the receiver has been moved to a waiting position opposite to the attaching-detaching position, and stopping a movement of the receiver for a predetermined time period at the waiting position after the pre-printing is terminated and the receiver has returned to the waiting position, and executing a post-printing process that prints on an image printed by the pre-printing process, while the receiver is moved to the attaching-detaching position, after the predetermined time period has elapsed.

BRIEF DESCRIPTION OF THE DRAWINGS

A more complete appreciation of the present disclosure and many of the attendant advantages of the present disclosure will be more readily obtained as substantially the same becomes better understood by reference to the following detailed description when considered in connection with the accompanying drawings, wherein.

DETAILED DESCRIPTION

Figure 1:
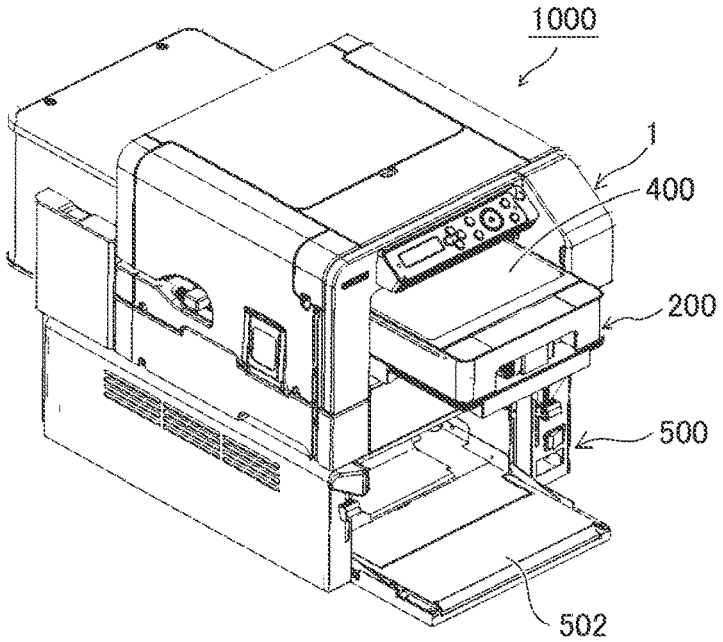
FIG. 1 is a perspective view illustrating an example of an image applying apparatus (i.e., image applying system) including an example of a printer to which a cassette is attached and an example of a heating device, according to one embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
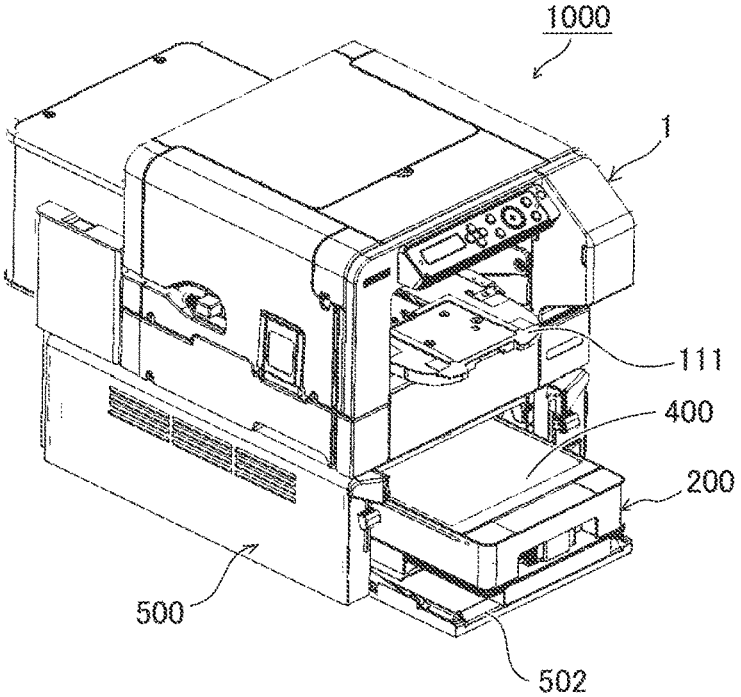
FIG. 2 is a perspective view illustrating an example of the image applying apparatus including the printer and the heating device in which the cassette is inserted, according to one embodiment of the present disclosure.

Referring now to the drawings, wherein like reference numerals designate identical or corresponding parts throughout the several views thereof, and in particular to FIG. 1 and FIG. 2, one example of an image applying apparatus (i.e., image applying system) according to one embodiment of the present disclosure is initially described.

FIG. 1 illustrates an example of an image applying apparatus including an example of printer to which a cassette is attached and an example of a heating device. FIG. 2 illustrates the image applying apparatus including the printer and the heating device in which the cassette is inserted.

The image applying apparatus 1000 includes a cassette (as a holder) 200. The image applying apparatus 1000 also includes a printer 1 and a heating device 500. The cassette 200 is a cloth holder which holds a cloth (as a printing object) 400 while a printing area of the cloth 400 is flat. The cassette 200 is used by both the printer 1 and the heating device 500.

The printer 1 is detachably attached to the cassette 200. The printer also prints an image on the cloth 400 held on the cassette 200. The cassette 200 is detachably attached to the heating device 500. The heating device 500 heats the cassette 200 holding the cloth 400 on which the image is printed. Thereby, the heating device 500 fixes the image on the cloth 400.

FIG. 1 and FIG. 2 show that the printer 1 is placed on the heating device 500. However, the printer 1 and the heating device 500 can be arranged side by side because they are independent devices. The printer 1 and the heating device 500 also can be placed separately.

When the image applying apparatus 1000 applies the image to the cloth 400, the cassette 200 holding the cloth 400 is set (i.e., attached) onto a stage 111 in the printer 1, as illustrated in FIG. 1. Then, the printer 1 prints the image on the cloth 400.

After the printing is terminated, the cassette 200 holding the cloth 400 is taken out of the printer 1. Then, after a front door 502 of the heating device 500 is opened, and the cassette 200 is inserted into the heating device 500 as illustrated in FIG. 2. Then, after the front door 502 of the heating device 500 is closed, the heating device 500 heats the cassette 200 holding the cloth 400. The image printed on the cloth 400 is fixed on the cloth 400 by heating.

In this way, the cassette as holder 200 is used by both the printer 1 and the heating device 500.

Thus, the printed cloth 400 can be set to the heating device 500 keeping the same state as that in the printing operation. Hence, even when the printed cloth 400 is carried, the printed cloth 400 does not wrinkle or even partially overlap, thereby preventing distortion of a printing surface of the printed cloth 400. Hence, the efficiency of the work of setting the cloth 400 by an operator greatly improves.

Figure 3:
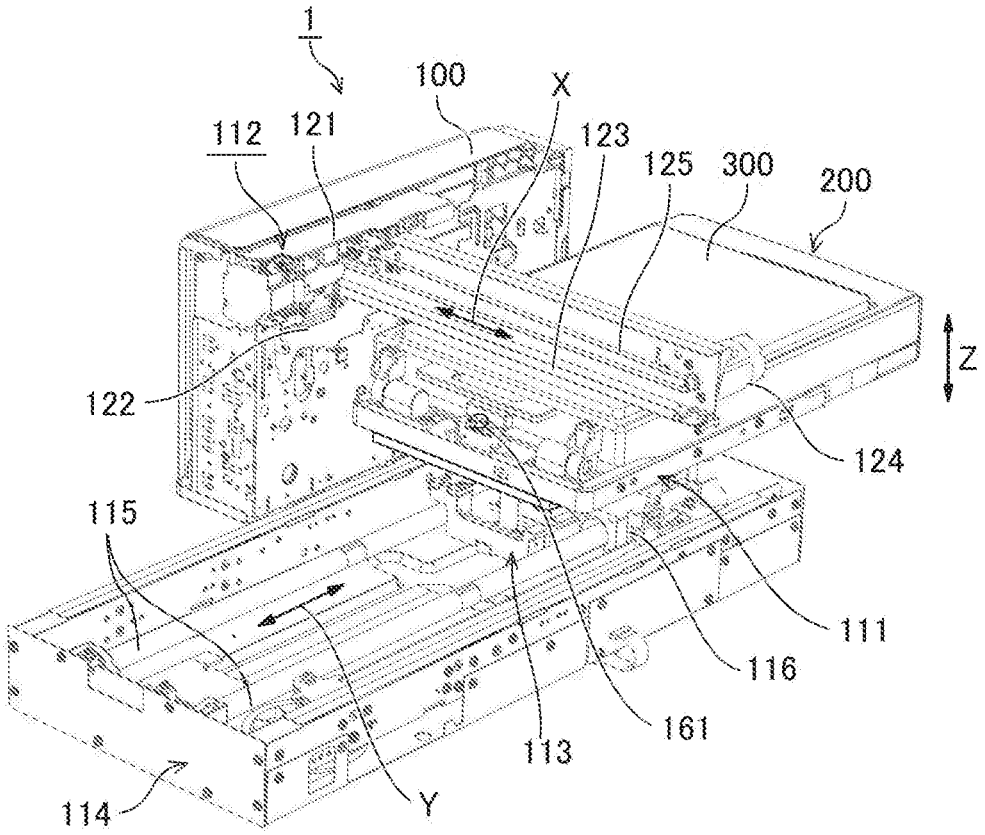
FIG. 3 is a perspective view illustrating an entire configuration of an example of the components of the printer, according to one embodiment of the present disclosure.
Figure 4:
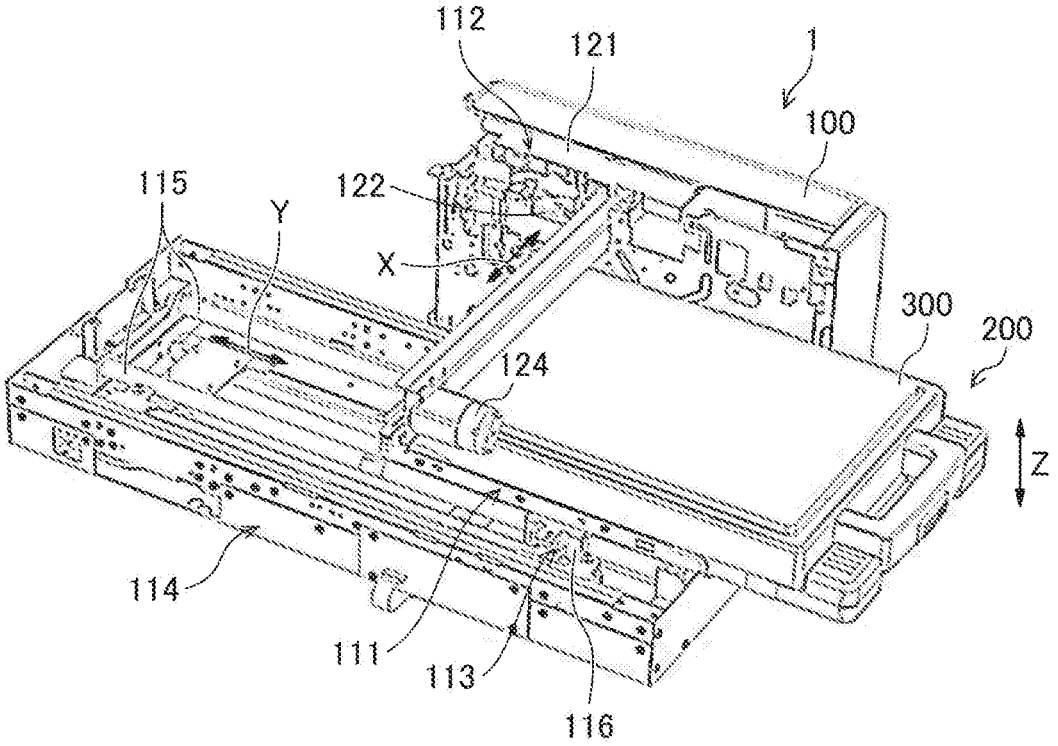
FIG. 4 is a perspective view illustrating the entire configuration of the mechanism of the printer taken from a direction different from that of a view of FIG. 3, according to one embodiment of the present disclosure.

Now, with reference to FIG. 3 and FIG. 4 in addition to FIGS. 1 and 2, one example of the printer according to one embodiment of the present disclosure is described. FIG. 3 is a perspective view illustrating an entire configuration of the components of the printer. FIG. 4 is a perspective view illustrating the entire configuration of the components of the printer taken from a direction different from that of the view of FIG. 3.

The printer 1 includes the stage 111 acting as a receiver (i.e., a cassette receiver) to detachably hold the cassette 200 holding the cloth 400 thereon. The stage 111 is moved back and forth (i.e., reciprocated) in a device body 100. The printer 1 also includes a printing mechanism 112 that prints the image on the cloth 400 held on the cassette 200 in the device body 100.

As the cloth 400, not only a cloth formed in one sheet such as a handkerchief, a towel, etc., but also a cloth processed as a garment such as a T-shirt, a sweatshirt, etc., and a cloth constituting a part of a product, such as a tote bag, etc., are employed as well.

The stage 111 is disposed on a carrier structure 113. The carrier structure 113 is movable back and forth in directions indicated by a double-headed arrow Y (i.e., carrying direction).

The device body 100 includes a bottom housing 114 at a bottom thereof. A pair of carrier guides 115 is placed in the bottom housing 114 along the direction indicated by the arrow Y. A slider 116 is correspondingly provided in the carrier structure 113 and is movably held by the pair of carrier guides 115.

The printing mechanism 112 includes a carriage 121 that moves relative to the stage 111 in the directions indicated by the double-headed arrow X (i.e., in a main scanning direction). The printing mechanism 112 also includes a head 122 mounted on the carriage 121 as well.

The carriage 121 is movably held by a guide 123 that also extends in the direction indicated by the arrow X and is configured to reciprocate in both directions indicated by the arrow X by a driving motor 124 that transmits a driving force thereto through a scanning mechanism, such as a timing belt 125, etc. The head 122 is typically a liquid discharge head that forms an image by discharging ink on a surface of the cloth. However, the head 200 of the present disclosure is not limited to the liquid discharge head.

The printer 1 holds the cassette 200 on the stage 111 with the cloth 400 being set to a platen 300 of the cassette 200. By repeatedly moving the head 122 in the directions indicated by the double-headed arrow X and moving the stage 111 in the directions indicated by the double-headed arrow Y, a prescribed image is printed on the cloth 400.

The stage 111 is elevatable in the directions indicated by the double-headed arrow Z. It is possible to adjust a gap between the cloth 400 and the head 122 by elevating the stage 111 according to a thickness of the cloth 400. The printing mechanism can be elevatable in the directions indicated by double-headed arrow Z.

Figure 5:
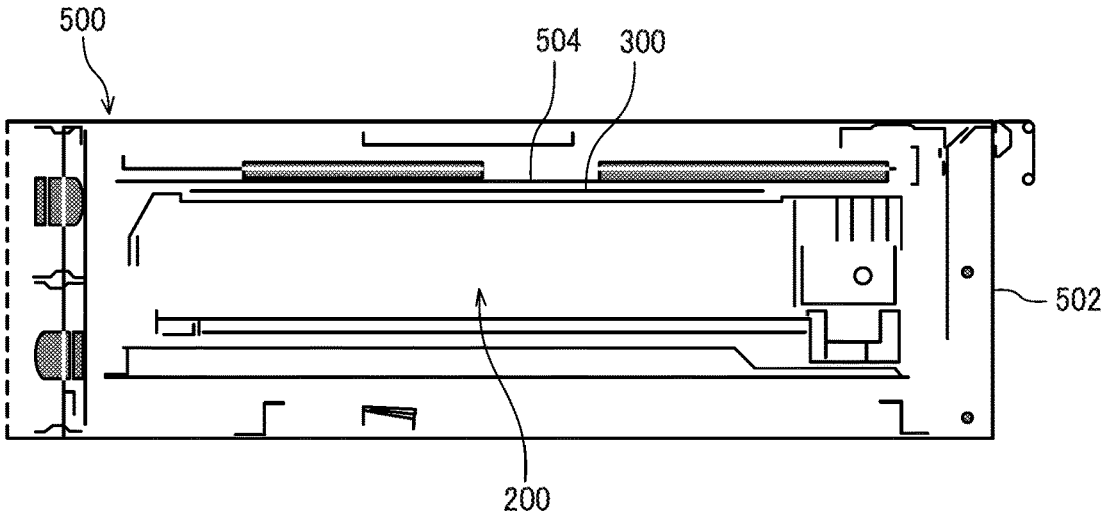
FIG. 5 is a cross-sectional view illustrating the heating device along a longitudinal direction (i.e., a direction in which the cassette is moved in and out the heating device) of the heating device, according to one embodiment of the present disclosure.
Figure 6:
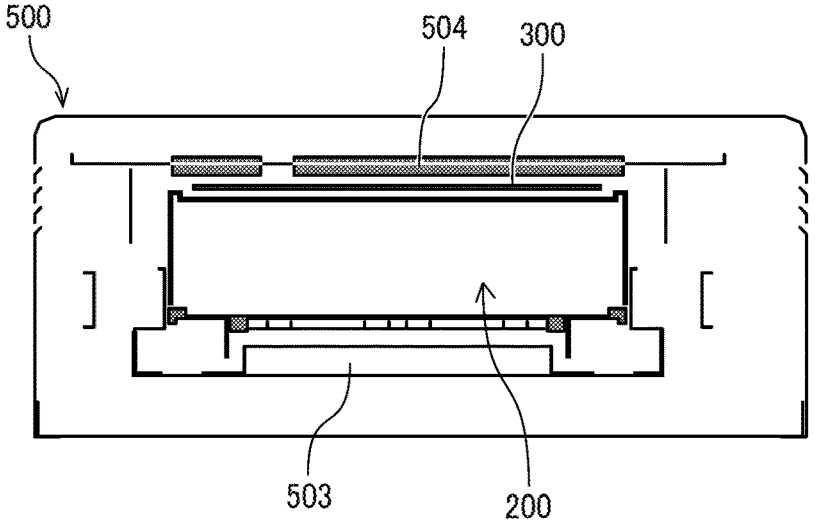
FIG. 6 is a cross-sectional view illustrating the heating device along a short direction (i.e., a direction perpendicular to the direction illustrated in FIG. 5) of the heating device, according to one embodiment of the present disclosure.

Next, with reference to FIG. 5 and FIG. 6, one example of the heating device according to one embodiment of the present disclosure is described. FIG. 5 is a cross-sectional view illustrating the heating device along a longitudinal direction (i.e., a direction that the cassette is moved in and out the heating device) of the heating device. FIG. 6 is a cross-sectional view illustrating the heating device along a short direction (i.e., a direction perpendicular to the direction illustrated in FIG. 5) of the heating device.

The heating device 500 includes a cassette receiver 503 to which the cassette 200 is detachably attached. The heating device 500 also includes a heater 504 to heat the cloth 400 held by the cassette 200.

The heater 504 is opposed to the platen 300 of the cassette 200. The heater 504 heats the cloth 400 held by the cassette 200 without contacting the cloth 400.

The heating device 500 can include a plane member made of a high thermal conductivity material. The plane member can be disposed on a cassette-side surface of the heater 504. In this way, despite the heating position of the heater 504, the heater 504 can heat the cloth 400 so that the surface temperature of the cloth 400 can be substantially uniform.

Figure 8:
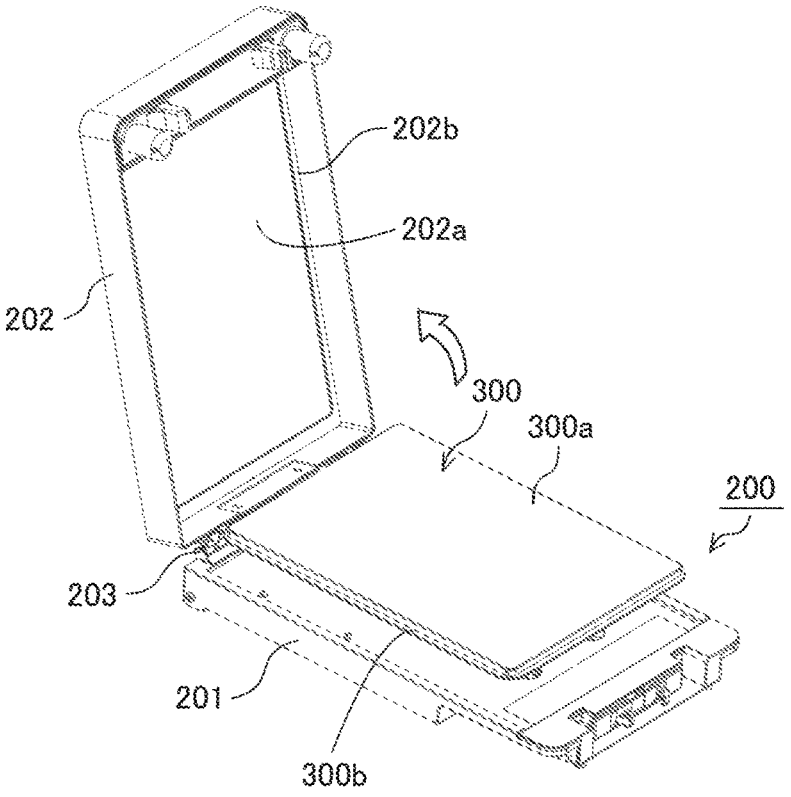
FIG. 8 is a perspective view illustrating a status of the cassette when a platen peripheral cover of the cassette is opened according to one embodiment of the present disclosure.
Figure 9:
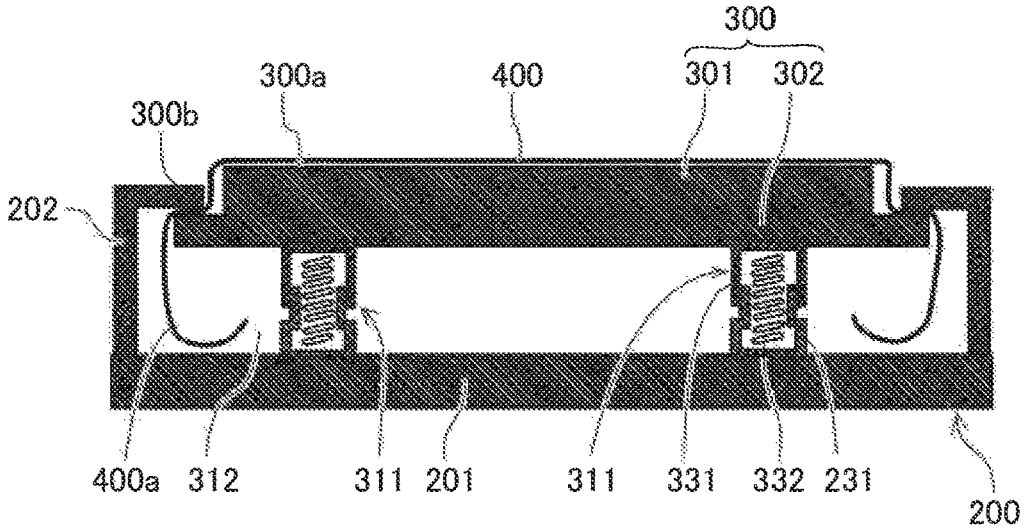
FIG. 9 is a cross-sectional view illustrating the cassette along a short direction of the cassette according to one embodiment of the present disclosure.

Now, with reference to FIGS. 7 to 9, one example of a cassette as a holder according to present disclosure is herein below described in detail.

Figure 7:
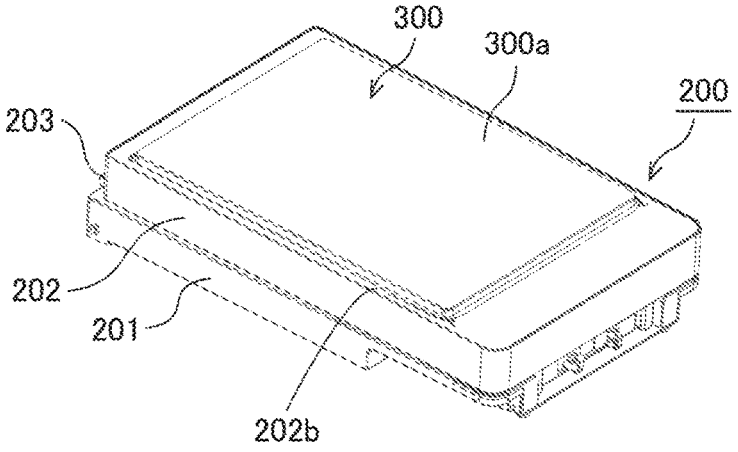
FIG. 7 is a perspective view illustrating an example of the cassette as a holder according to one embodiment of the present disclosure.

FIG. 7 is a perspective view illustrating an example cassette. FIG. 8 is a perspective view illustrating an example status of the cassette when a platen peripheral cover of the cassette is opened. FIG. 9 is a cross-sectional view illustrating the cassette along a short direction of the cassette.

The cassette 200 includes a base 201 and the platen 300 to hold a printing part of the cloth 400 flat. The cassette 200 also includes a platen peripheral cover 202 to hold the cloth 400 between the platen 300 and the platen peripheral cover 202.

The platen 300 is configured by a platen structure 302 and a heat insulator 301 that constitutes a plane (i.e., holding plane) 300*a* that holds the cloth 400 flat thereon. The heat insulator 301 has a heat resistance that is resistant to the heat applied by the heating device 500.

The platen peripheral cover 202 includes a frame 202*b* defining an opening 202*a* disposed opposite the platen 300. The platen peripheral cover 202 is attached to the base 201 via a pair of hinges 203 and is openable to the base 201. The platen peripheral cover 202 presses the cloth 400 against a flange section 300*b* as an outer circumferential edge of the platen 300.

The platen 300 is supported above the base 201 by multiple supporters 311 extending from the base 201. Hence, the base 201 and the platen 300 collectively form a cloth accommodating space 312 between these members to accommodate a surplus portion 400*a* of the cloth 400. For example, the surplus portion 400*a* may be both sleeves, a collar mouth, and a bottom edge or the like of a T-shirt when a front side of the T-shirt is printed.

Each of the supporters 311 supporting the platen 300 includes a hollow pillar 231 disposed on a side of the base 201 and another hollow pillar 331 disposed on a side of the platen 300 to movably fit with the hollow pillar 231.

Each of the supporters 311 also includes a compression spring 332 disposed between the hollow pillar 231 and the other hollow pillar 331.

With this, the platen 300 is supported to be displaceable relative to the base 201.

As configurated in this way, when a cloth 400 (set to the platen 300) has a different thickness (e.g., thicker than an average), the platen 300 is depressed against a restoring force of the spring 322 while changing the distance from the base 201.

Here, the platen 300 is detachably attached to the base 201 and replaceable. With this, when multiple platens 300 are prepared, a cloth to be printed next is previously wrapped around one of the multiple platens 300 not used in a current printing. Hence, the printing of an image onto the next cloth can be started quickly by simply replacing the used platen 300 with a new platen 300 after printing and fixing process currently executed for the cloth is completed.

When the cloth 400 is set to (held by) the cassette 200, at first, the platen peripheral cover 202 is opened and a part of cloth 400 to be printed is set onto the platen 300. Subsequently, the surplus portion 400*a* of the cloth 400 is pushed into the cloth accommodating space 312. Finally, the platen peripheral cover 202 is closed.

Hence, the part of cloth 400 to be printed is held to be flat on the platen 300. Furthermore, the surplus portion 400*a* of the cloth 400 is accommodated into the cassette 200 without protruding from the cassette 200.

When the cloth 400 is being printed, the cassette 200 to which the cloth 400 is set is attached to the stage 111 in the device body 100 of the printer 1. Here, the cassette 200 can be attached to the stage 111 in the direction Y in which the stage 111 moves. By this configuration, when the cassette 200 is attached to the stage 111, it is not necessary that an entire stage 111 is exposed from the device body 100. Hence, compared to a configuration in which the cassette 200 is attached to the stage 111 vertically, the size of the printer 1 is small.

In this way, since the cloth 400 can be set onto the platen 300 in a state in which the cassette 200 is wholly drawn out of the device body 100, the work of setting the cloth 400 to the platen 300 becomes easier.

Figure 10:
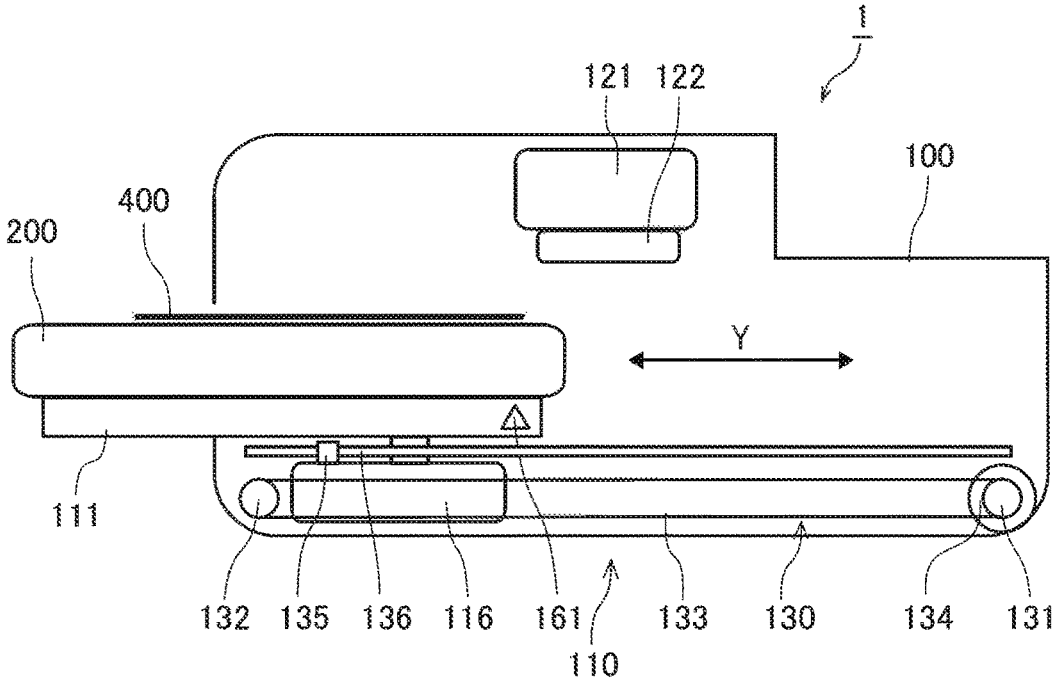
FIG. 10 is a diagram schematically illustrating the printer according to one embodiment of the present disclosure.
Figure 11:
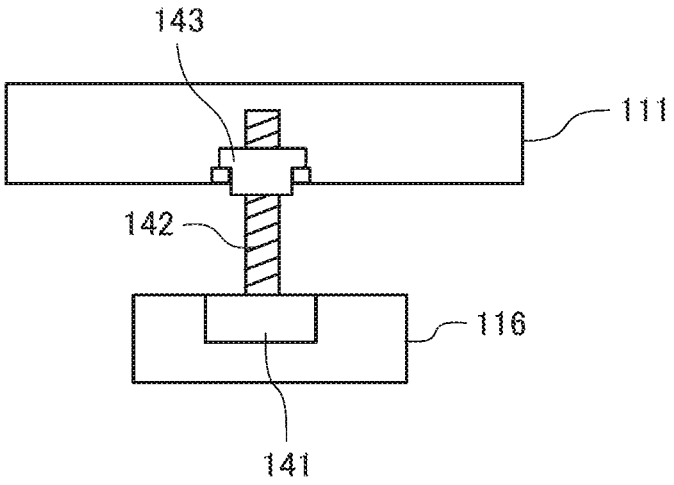
FIG. 11 is a diagram schematically illustrating a stage elevating mechanism of the printer according to one embodiment of the present disclosure.
Figure 12:
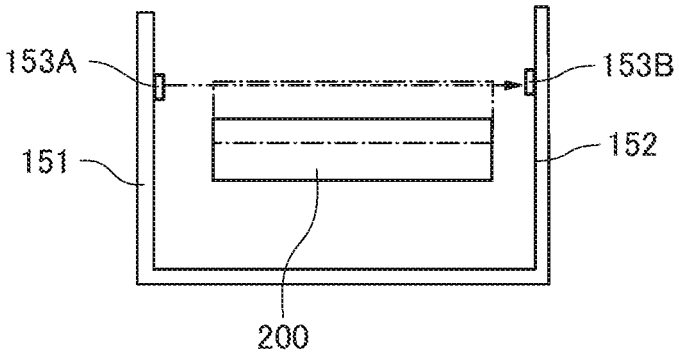
FIG. 12 is a diagram illustrating a stage height detector of the printer according to one embodiment of the present disclosure.

Now, a first embodiment of the present disclosure is described with reference to FIGS. 10 to 12. FIG. 10 is a diagram schematically illustrating the printer according to the first embodiment of the present disclosure. FIG. 11 is a diagram schematically illustrating a stage elevating mechanism of the printer. FIG. 12 is a diagram illustrating a stage height detector of the printer.

The printer 1 includes the stage 111 acting as a receiver to detachably hold the cassette 200 in the device body 100.

The stage 111 is disposed on the slider 116 configuring the carrier structure 113. The slider 116 is movable back and forth in directions indicated by a double-headed arrow Y by a drive mechanism 130. The drive mechanism 130 includes a timing belt 133 wound around a pair of pulleys 131,132 and a stage moving motor 134 to rotate the pair of pulleys 131,132.

Hence, the cassette 200 holding the cloth 400 is moved back and forth in the Y directions via the drive mechanism 130 and the stage 111 by driving the stage moving motor 134.

The stage 111, the carrier structure 113 including the slider 116 and the drive mechanism 130 configure a reciprocating mechanism 110 to move the cassette 200 back and forth between a waiting position and an attaching-detaching position. Here, the attaching-detaching position is a position at which the cassette 200 is attached to and detached from the stage 111.

The printer 1 includes an encoder scale 136 disposed along a direction in which the stage 111 moves and an encoder sensor 135 to read the encoder scale 136. Here, the encoder sensor 135 can be disposed on the slider 116 or the stage 111. The encoder scale 136 and the encoder sensor 135 configure a linear encoder to detect a position of the stage 111 in the Y direction.

The stage 111 is elevatable provided in a vertical (i.e., up-and-down) direction relative to the slider 116.

As illustrated in FIG. 11, a trapezoidal thread (i.e., screw) 142 which is driven by a stage elevating motor 141 is disposed on the slider 116. The trapezoidal thread 142 is extending along the vertical direction. The trapezoidal thread 142 is engaging with a nut 143 fixed on the stage 111.

As configured in this way, the trapezoidal thread 142 is rotated forward and backward by rotating the stage elevating motor 141, and the stage 111 is moved up and down (i.e., elevated) with respect to the slider 116. Hence, the cloth 400 held by the cassette 200 can be moved to the predetermined height position with respect to the head 122.

As illustrated in FIG. 12, a light emitter 153A is disposed on lateral plate 151, and a light receiver 153B is disposed on lateral plate 152 opposed to the lateral plate 151. The light emitter 153A and the light receiver 153B configure a transmissive photosensor as a cassette height detector. Thus, the transmissive photosensor detects that the cassette 200 or the cloth 400 has reached the predetermined height position.

The stage 111 also includes a cassette mount sensor (i.e., holder mount sensor) 161 for detecting that the cassette 200 is mounted on the stage 111. The cassette mount sensor 161 can be a push-type sensor that reacts by being pushed by the cassette 200.

Figure 13:
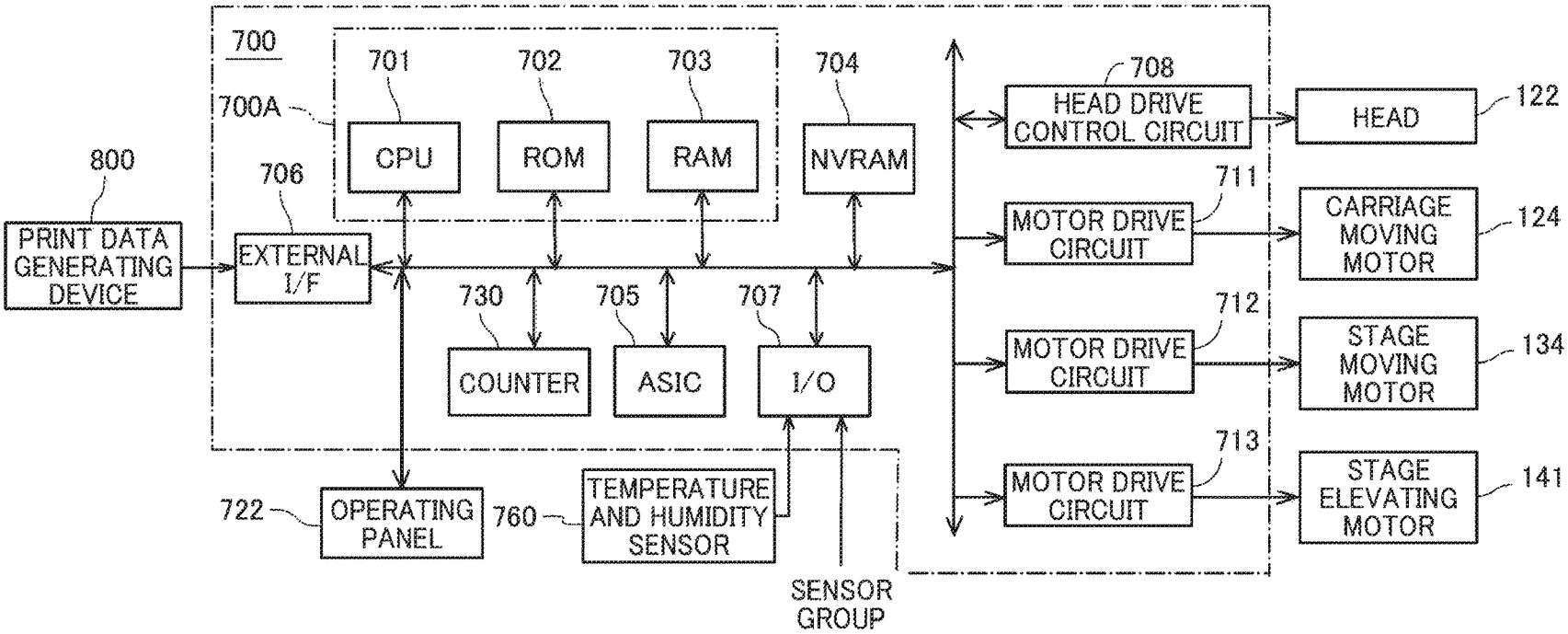
FIG. 13 is a block diagram of a controller circuitry of the printer according to one embodiment of the present disclosure.

A controller circuitry of the above-described printer is described below with reference to FIG. 13. FIG. 13 is a block diagram of a controller circuitry of the printer.

A controller circuitry 700 includes a main controller circuitry 700A including a central processing unit (CPU) 701, a read only memory (ROM) 702, and a random access memory (RAM) 703. The CPU 701 controls the overall printer. The ROM 702 stores a program that causes the CPU 701 to control a printing operation, and other fixed data. The RAM 703 temporarily stores image data and other data.

The controller circuitry 700 further includes a non-volatile random access memory (NVRAM) 704 that holds data even when power supply to the printer is cut off. The controller circuitry 700 further includes an application specific integrated circuit (ASIC) 705 that processes various signals corresponding to image data (i.e., executes image processing) and that processes input and output signals for controlling the overall printer.

The controller circuitry 700 further includes an external interface (I/F) 706 that transmits and receives data and signals used for receiving print data from an external print data generating device 800.

The print data generating device 800 generates print data. Print data includes image data to be printed on the cloth 400. The print data generating device 800 includes an information processing apparatus such as a personal computer.

The controller circuitry 700 further includes an input/output device (I/O) 707 that incorporates various sensor detection signals.

The controller circuitry 700 further includes a head drive control circuit 708 that controls the head 122.

The controller circuitry 700 further includes motor drive circuits 711, 712, 713. The motor drive circuit 711 drives a carriage moving motor 124 that moves the carriage 121 in the X direction (i.e., main scanning direction). The motor drive circuit 712 drives a stage moving motor 134 that moves the stage 111 in the Y direction (i.e., sub-scanning direction). The motor drive circuit 713 drives a stage elevating motor 141 that elevates the stage 111 in the Z direction.

To the I/O 707 of the controller circuitry 700, detection signals are input. One example of the detection signals is a signal from a thermo-hygro sensor 760 that detects temperature and humidity of the usage environment for the printer. The detection signals further include output signals from the light receiver 153B, the encoder sensor 135 and the cassette mount sensor 161 and other detection signals from other sensors.

The controller circuitry 700 is connected to an operation panel 722 for inputting and displaying necessary information for the printer.

The controller circuitry 700 receives the print data from the print data generating device 800 and creates the image data based on the print data. The head drive control circuit 708 included in the controller circuitry 700 drives the head 122 according to the image data. While the carriage 121 is moved in the X direction and the stage 111 is intermittently moved in the Y direction, the controller circuitry 700 causes the head 122 to discharge droplets (e.g. ink droplets). Hence, the controller circuitry 700 controls the printing of an image on the cloth 400 held by the cassette 200.

Next, a superimposed printing according to a first embodiment of the present disclosure is described below with reference to a flowchart illustrating in FIG. 14 and diagrams illustrating in FIGS. 15 to 19.

With reference to FIG. 10, a user sets the cloth 400 as a printing object on the cassette 200, and then attaches the cassette 200 to the stage 111 in the device body 100, and then gives a printing instruction to the printer 1.

Figure 14:
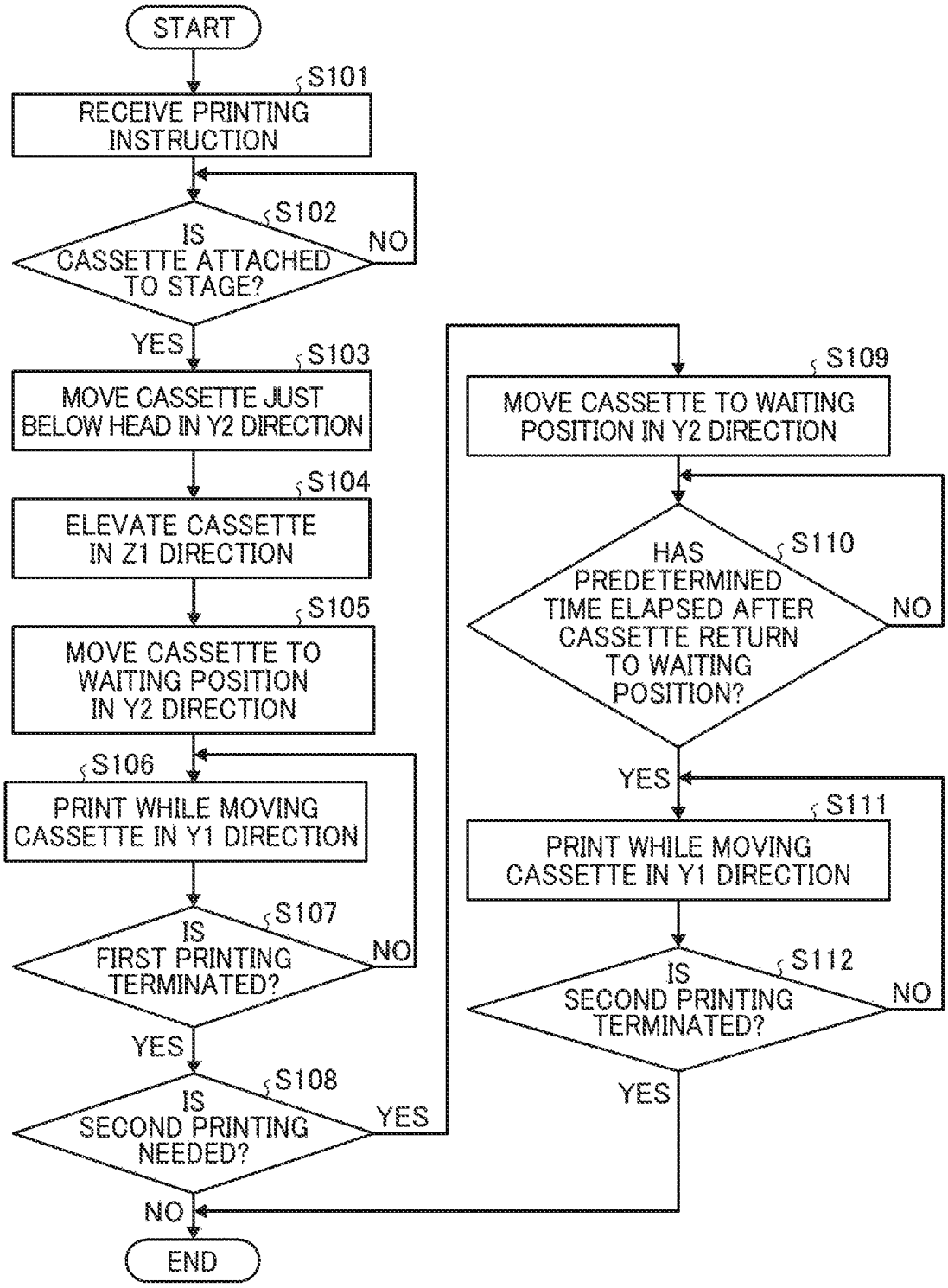
FIG. 14 is a flowchart illustrating a superimposed printing according to a first embodiment of the present disclosure.
Figure 15A:
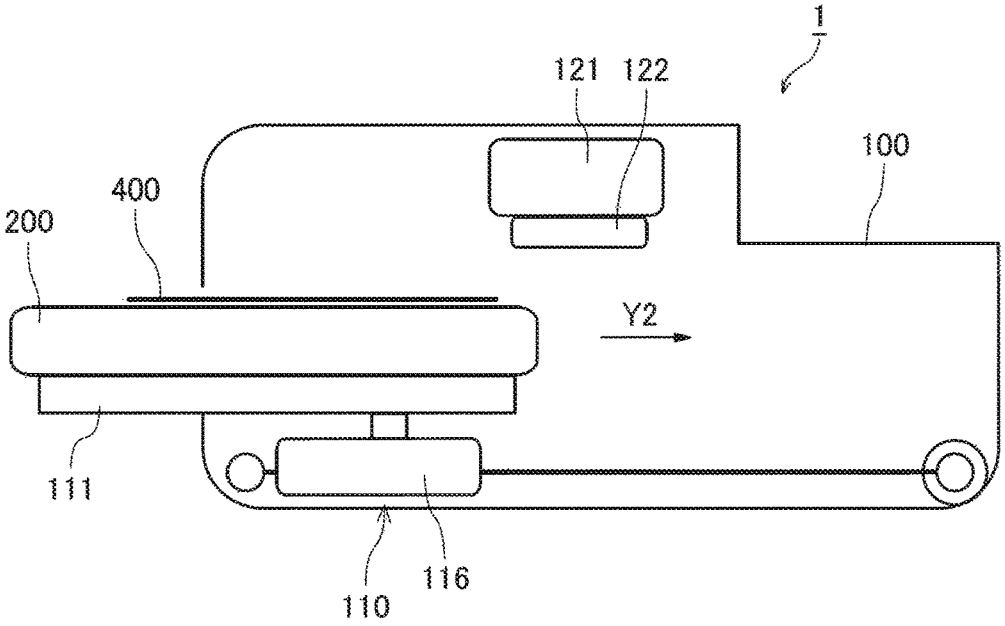
FIGS. 15A and 15B are diagrams schematically illustrating the superimposed printing according to the first embodiment of the present disclosure.
Figure 15B:
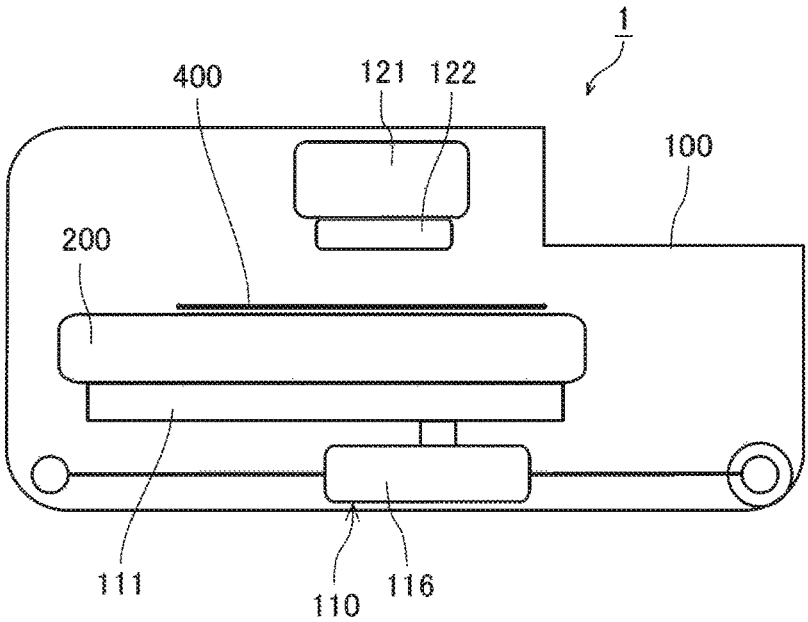

With reference to FIG. 14, after the printer 1 receives the printing instruction in step S101, the cassette mount sensor 161 detects whether the cassette 200 is attached to the stage 111 or not in step S102. When the cassette mount sensor 161 detects that the cassette 200 is attached to the stage 111, the controller circuitry 700 moves the stage 111 in the Y2 direction to just below the head 122, as illustrated in FIG. 15A and FIG. 15B, in step S103.

Figure 16A:
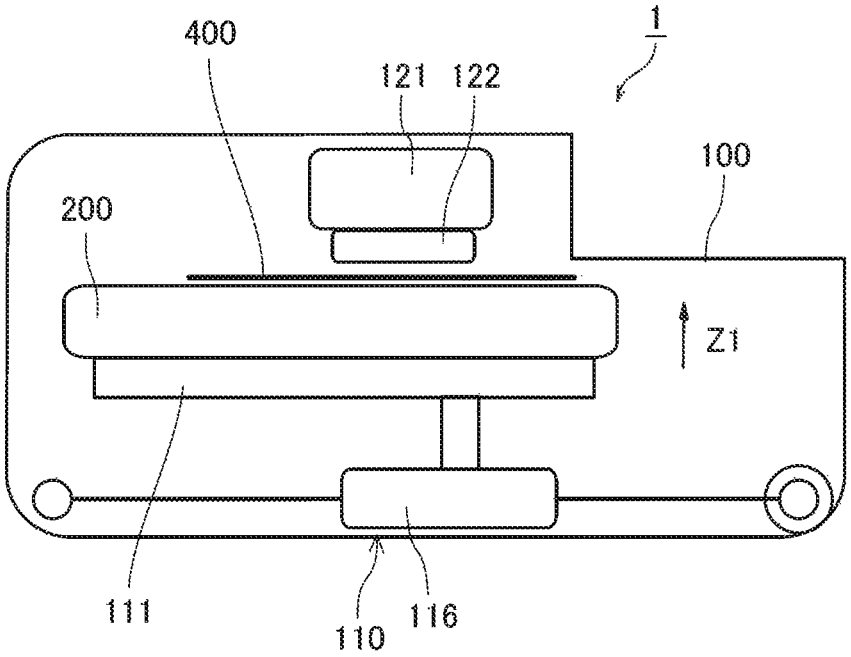
FIG. 16A is a diagram schematically illustrating the superimposed printing according to the first embodiment of the present disclosure.
Figure 16B:
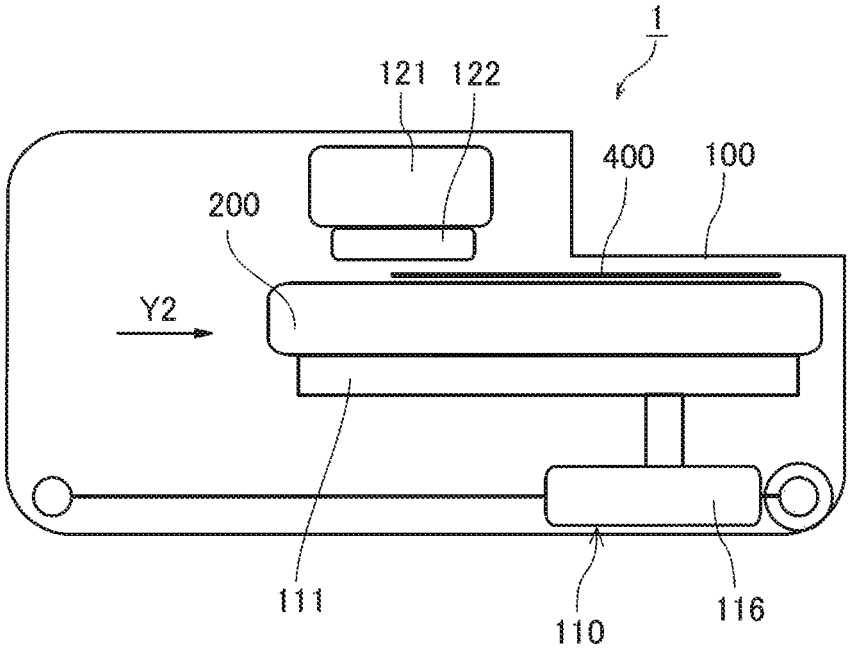
FIG. 16B is a diagram schematically illustrating the superimposed printing according to the first embodiment of the present disclosure.

Next, as illustrated in FIG. 16A, the controller circuitry 700 elevates the stage 111 in the Z1 direction to a predetermined height position, in step S104. Then, as illustrated in FIG. 16B, the controller circuitry 700 moves the stage 111 in the Y2 direction to a waiting position, in step S105.

The waiting position is a movement start position at which a movement of the cassette 200 toward the Y1 direction opposite to the Y2 direction starts, for printing the image on the cloth 400. The waiting position can be described as a print start position or an initial position. In the first embodiment of the present disclosure, the waiting position and the attaching-detaching position are in opposite positions in a direction in which the cassette 200 reciprocates. Hence, in the first embodiment of the present disclosure, after the cassette 200 is moved from the attaching-detaching position to the waiting position, the printing operation is started.

Figure 17A:
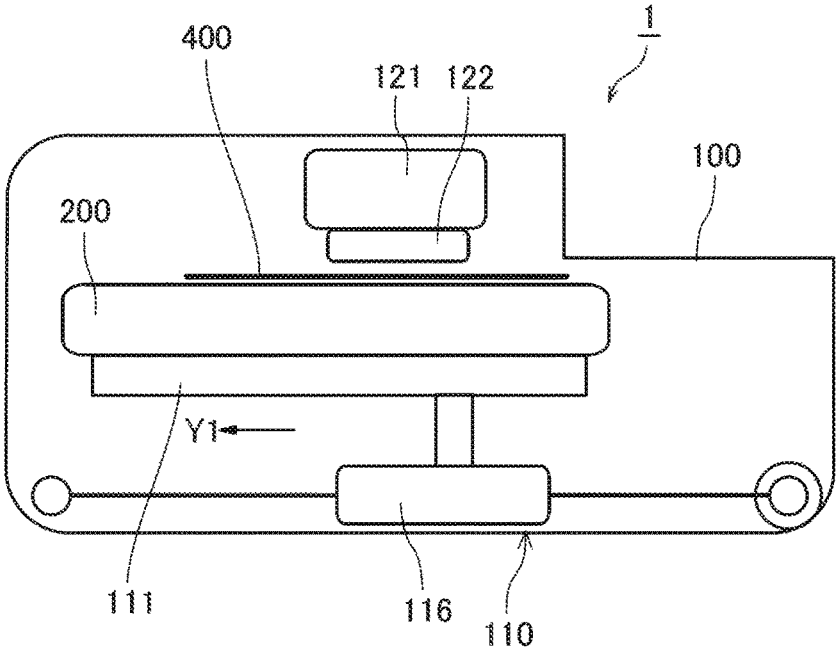
FIG. 17A is a diagram schematically illustrating the superimposed printing according to the first embodiment of the present disclosure.

Then, as illustrated in FIG. 17A, the controller circuitry 700 causes the head 122 to discharge droplets while the stage 111 is moved in the Y1 direction from the waiting position, in step S106. In this way, a first printing process (i.e., pre-printing process) on the cloth 400 held by the cassette 200 is executed.

Figure 17B:
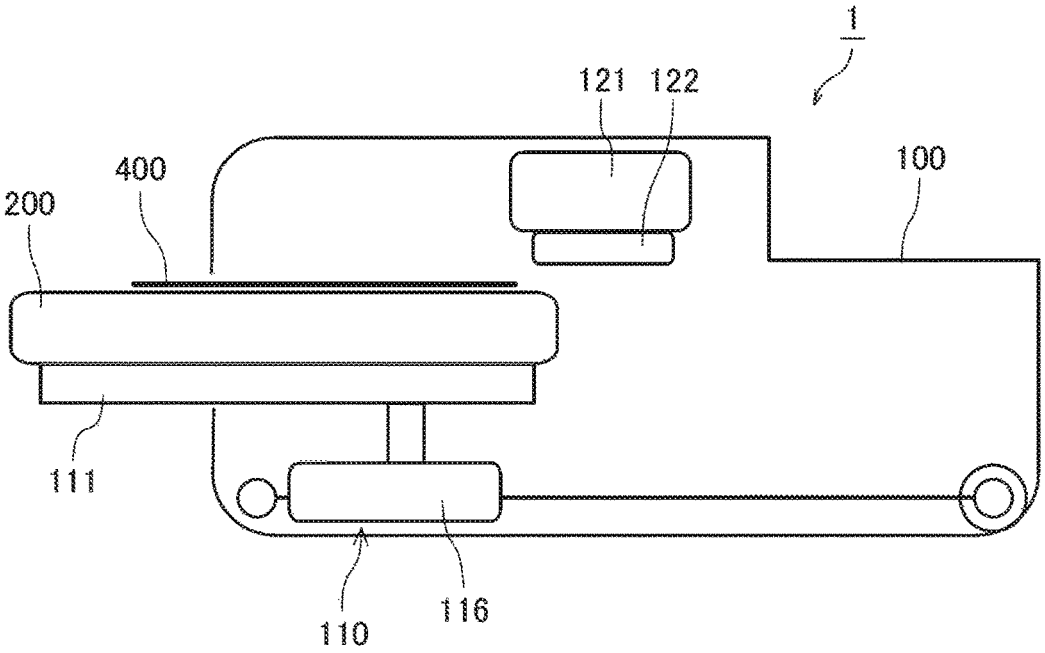
FIG. 17B is a diagram schematically illustrating the superimposed printing according to the first embodiment of the present disclosure.

When the first printing process is terminated, the stage 111 has been moved to the attaching-detaching position, as illustrated in FIG. 17B.

After the first printing is terminated in step S107, the controller circuitry 700 determines whether a second printing process (i.e., post-printing process) is needed or not in step S108.

When the second printing process is not needed, the printer 1 terminates the printing operation. The user detaches the cassette 200 from the stage 111 and sets the cassette 200 to the heating device 500.

Figure 18A:
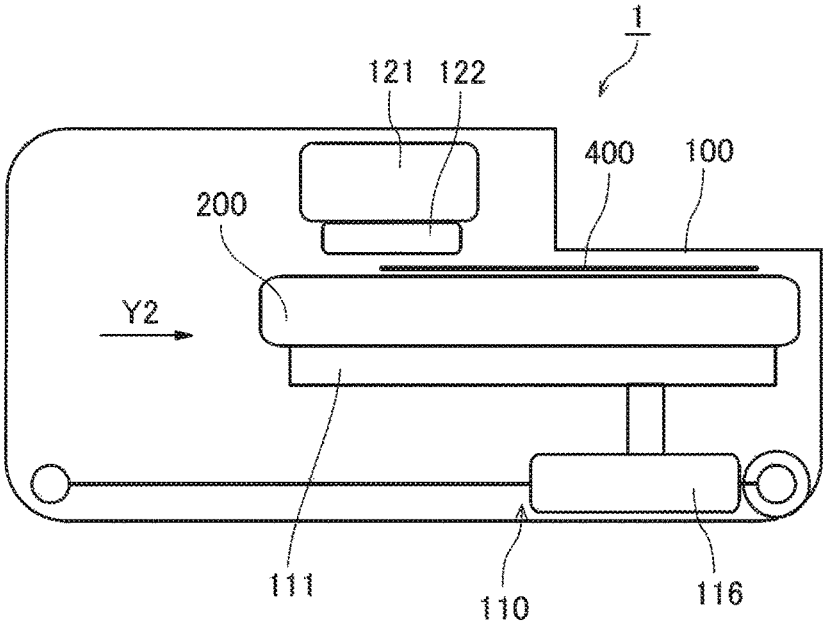
FIG. 18A is a diagram schematically illustrating the superimposed printing according to the first embodiment of the present disclosure.

When the second printing process is needed, the stage 111 mounting the cassette 200 is moved in the Y2 direction to the waiting position, as illustrated in FIG. 18A, in step S109.

In step S110, after the cassette 200 has returned to the waiting position, the controller circuitry 700 determines whether a predetermined time period has elapsed or not. The cassette 200 stands by at the waiting position until the predetermined time period has elapsed. Hence, after the first printing process is terminated and before the second printing process is executed, the controller circuitry 700 stops the movement of the cassette 200 for the predetermined time period.

One example of the above operation is concretely described. After the cassette 200 has returned to the waiting position, the motor drive circuit 712 stops driving the stage moving motor 134. Then, a counter 730 included in the controller circuitry 700 starts counting to a number. When the counter 730 has counted a predetermined number as the predetermined time period stored in the ROM 702, the motor drive circuit 712 drives the stage moving motor 134.

The counter 730 can measure the elapsed time starting from when the cassette 200 has returned to the waiting position.

Figure 18B:
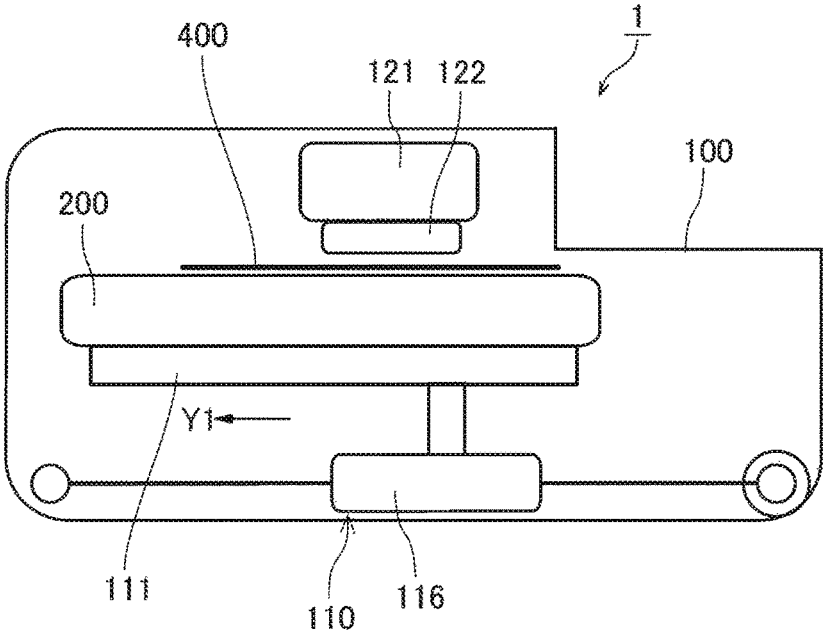
FIG. 18B is a diagram schematically illustrating the superimposed printing according to the first embodiment of the present disclosure.

In step S111, after the predetermined time period has elapsed, the controller circuitry 700 causes the head 122 to discharge droplets while the stage 111 holding the cassette 200 is moved in the Y1 direction, as illustrated in FIG. 18B. In this way, the second printing process (i.e., the post-printing process) on the cloth 400 held by the cassette 200 is executed.

Figure 19:
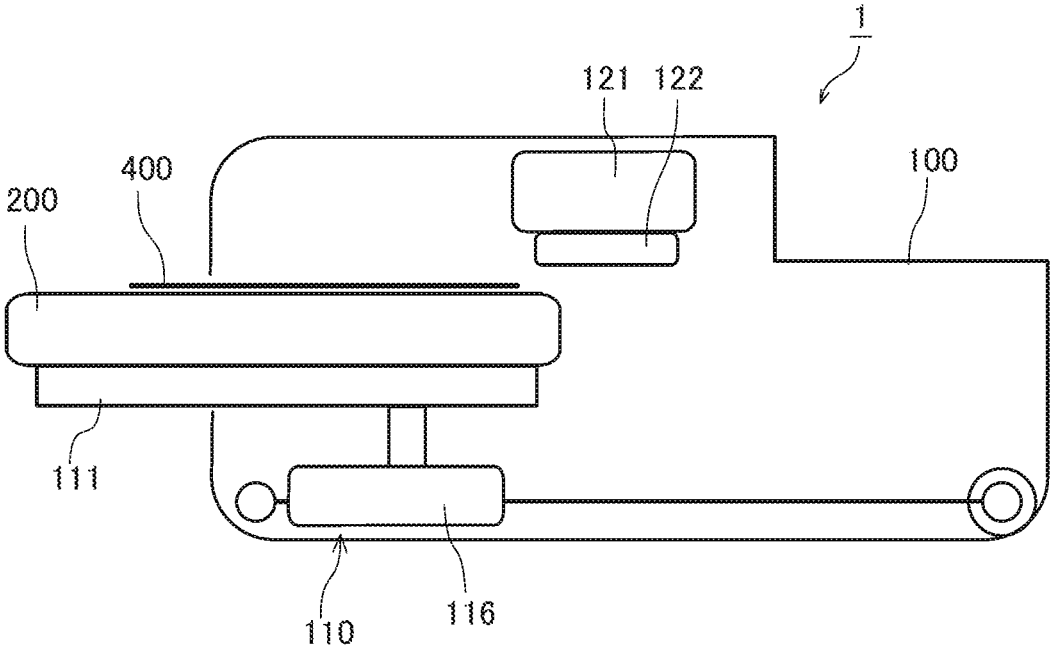
FIG. 19 is a diagram schematically illustrating the superimposed printing according to the first embodiment of the present disclosure.

When the second printing process is terminated, the stage 111 is located at the attaching-detaching position, as illustrated in FIG. 19.

In step S112, the controller circuitry 700 determines whether the second printing process is terminated or not.

When the second printing process is terminated, the printer 1 terminates the printing operation. Then, the user detaches the cassette 200 from the stage 111 and sets the cassette 200 to the heating device 500.

As stated above, the printer 1 according to the first embodiment of the present disclosure executes the superimposed printing on the cloth 400 by the following steps:

1. The cassette 200 holding the cloth 400 is detachably attached to the stage 111 in the device body 100 of the printer 1,
2. Move the stage 111 from the attaching-detaching position to the waiting position, and then execute the pre-printing process while the stage 111 is moved to the attaching-detaching position,
3. Return the stage 111 to the waiting position after the pre-printing process is terminated, and stop the movement of the stage 111 for the predetermined time period, and
4. Execute the post-printing process while the stage 111 is moved to the attaching-detaching position after the predetermined time period has elapsed.

Here, print data for the pre-printing process and print data for the post-printing process can be the same. In this way, the image printed on the cloth 400 increases in density. Also, print data for the pre-printing process and print data for the post-printing process can be different, such as print data for undercoating and print data for a target image.

The printer 1 can also execute the superimposed printing by printing three or more times.

In this way, the controller circuitry 700 stops the movement of holder for the predetermined time period before the image by the post-printing process is superimposed on the image by the pre-printing process. Hence, after the vibration of the holder involved with the movement of holder has been damped, the printer 1 can start the post-printing process. Therefore, a positional displacement between the image by the pre-printing process and the image by the post-printing process is decreased. Thereby, a print quality is raised.

In the first embodiment of the present disclosure, while the stage 111 is moved from the attaching-detaching position to the waiting position, the printer 1 does not print. The moving velocity at which the stage 111 returns to the waiting position is faster than that at which the stage 111 moves during the printing operation. Thereby, when the stage 111 returns to the waiting position, the vibration occurs in the cassette 200 held by the stage 111.

After the stage 111 has returned to the waiting position, the printer 1 stops the movement of the stage 111 until the vibration that occurred in the cassette 200 is damped so that the image by the post-printing process is not shifted to the image by the pre-printing process.

In the first embodiment of the present disclosure, the cloth 400 is not directly held by the stage 111, and thereby not wrapped around the stage 111, but is held by the cassette 200 detachably attached to the stage 111. In this configuration, it is especially effective to stop the movement of the stage 111 for the predetermined time period because the vibration is likely to occur in the cassette 200 detachably attached to the stage 111.

Figure 20:
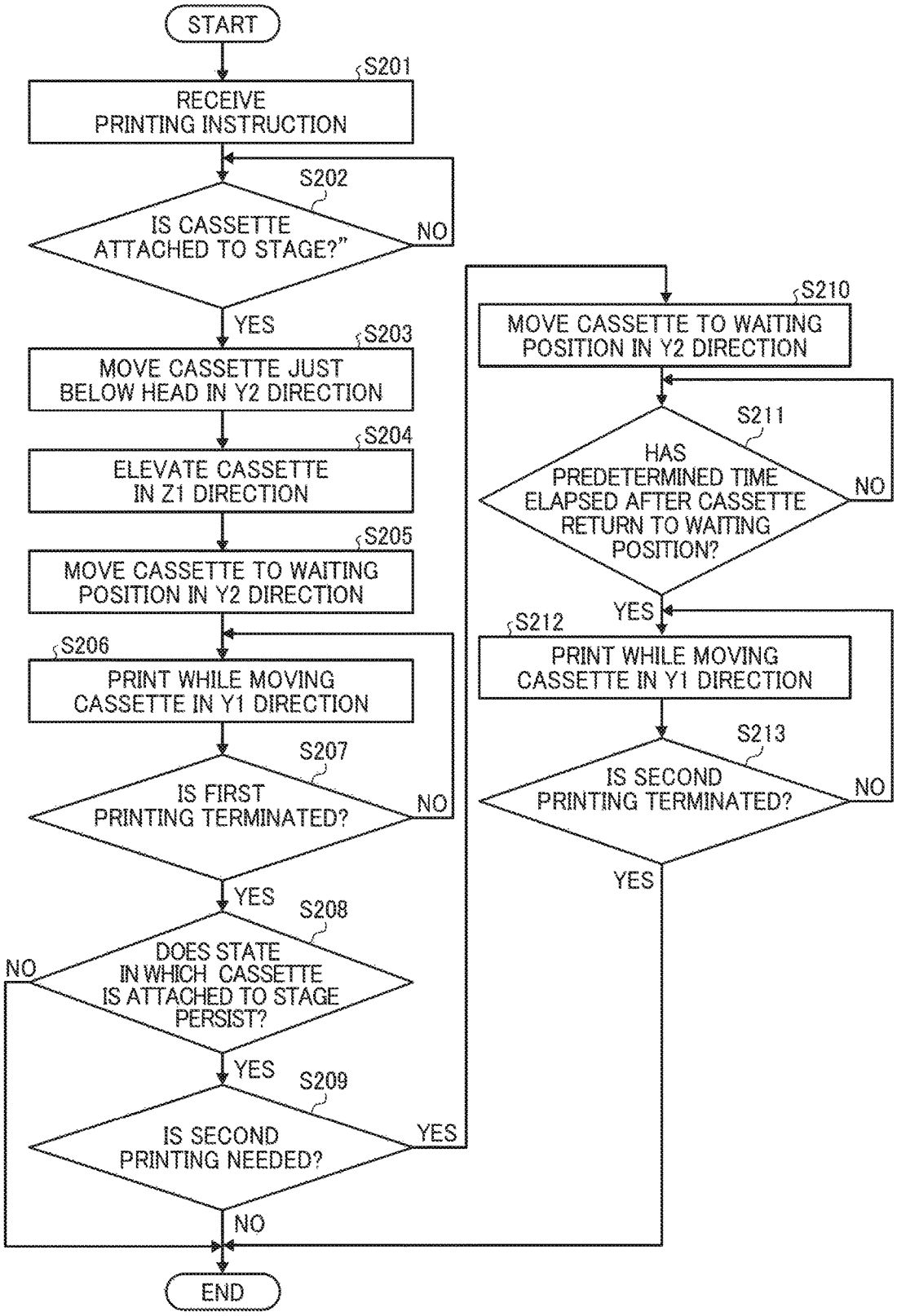
FIG. 20 is a flowchart illustrating the superimposed printing according to a second embodiment of the present disclosure.

Next, another superimposed printing in a second embodiment of the present disclosure is described with reference to the flowchart illustrating in FIG. 20.

The first printing process is executed by performing steps S201 to S206, which are the same as steps S101 to S106 illustrated in FIG. 14. Then, the controller circuitry 700 determines whether the first printing process is terminated or not in step S207.

When the first printing process (i.e., the pre-printing process) is terminated, the controller circuitry 700 determines whether the state in which the cassette mount sensor 161 detects the cassette 200 persists or not in step S208.

When the state in which the cassette mount sensor 161 detects the cassette 200 persists, the controller circuitry 700 determines whether a second printing process (i.e., the post-printing process) is needed or not in step S209. When the second printing process is needed, as with the first embodiment of the present disclosure, the second printing process is executed in steps S210 to S213.

When the state in which the cassette mount sensor 161 detects the cassette 200 does not persist, i.e., the cassette mount sensor 161 detects at least one time that the cassette 200 is not mounted on the stage 111, the printer 1 terminates the printing operation without executing the second printing.

In the case that the cassette 200 has been detached from the stage 111 after the first printing process is terminated, even if the cassette 200 is attached to the stage 111 again, a positional relation between the cassette 200 and the stage 111 in the second printing process might be different with that in the first printing process.

Thus, in the superimposed printing of the second embodiment of the present disclosure, when the cassette mount sensor 161 detects at least one time that the cassette 200 is not mounted on the stage 111, the printer 1 does not execute the second printing process.

Figure 21:
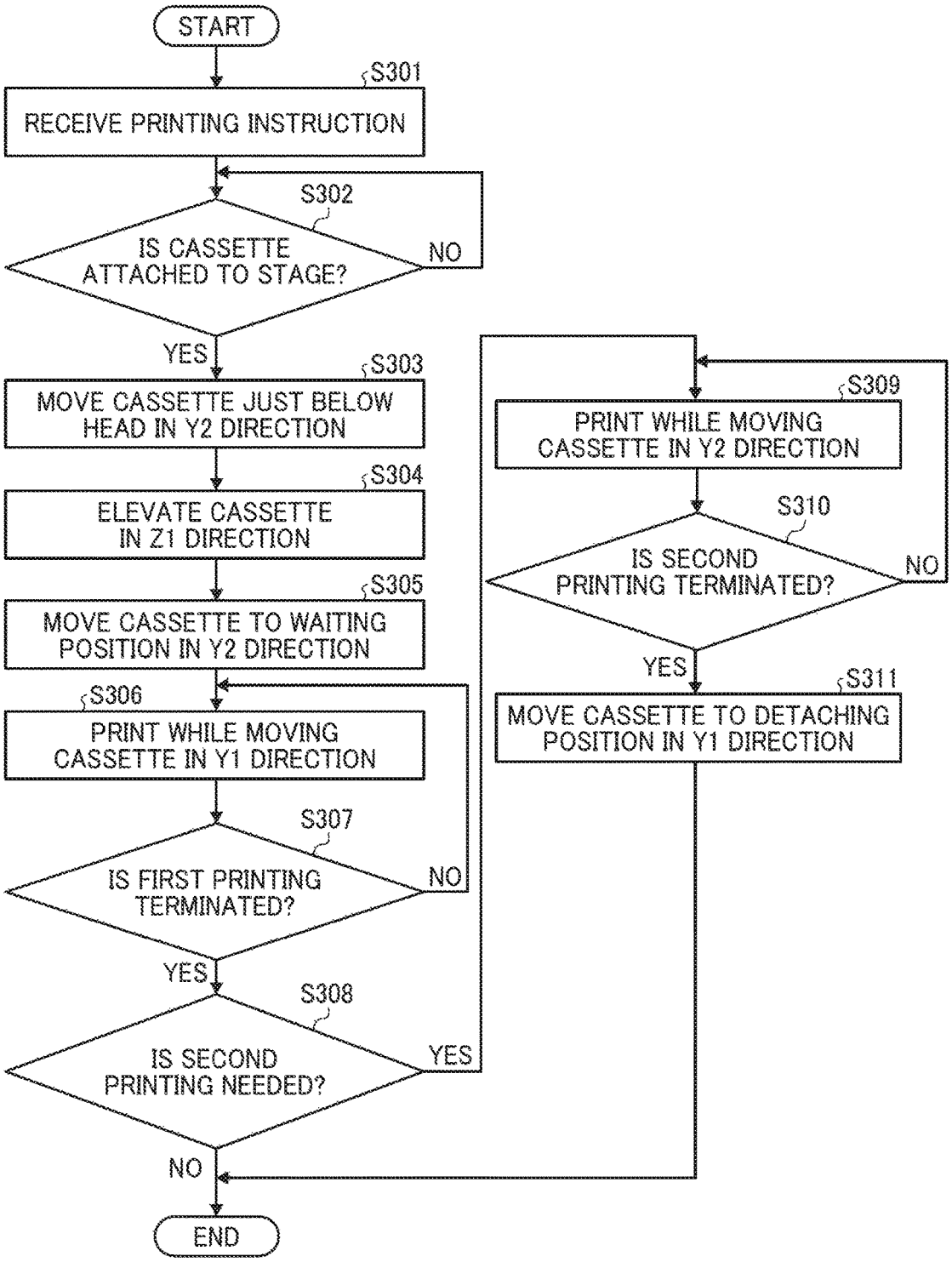
FIG. 21 is a flowchart illustrating the superimposed printing according to a third embodiment of the present disclosure.

Next, another superimposed printing in a third embodiment of the present disclosure is described with reference to the flowchart illustrating in FIG. 21.

The first printing is executed by performing steps S301 to S307, which are the same as steps S101 to S107 illustrated in FIG. 14. After the first printing process is terminated, the controller circuitry 700 determines whether a second printing process is needed or not in step S308.

When the second printing process is needed, the second printing process is executed while the cassette 200 is moved in the Y2 direction illustrated in FIG. 18A in step S309.

In step S310, the controller circuitry 700 determines whether the second printing process is terminated or not. When the second printing process is terminated, the cassette 200 is moved in the Y1 direction to the attaching-detaching position illustrated in FIG. 18B in step S311.

In the third embodiment of the present disclosure, without stopping the movement of the cassette 200 for the predetermined time period before the second printing process is executed, the second printing process is executed while the stage 111 is intermittently moved in the Y2 direction illustrated in FIG. 18A.

When the cassette 200 has been moved to the attaching-detaching position in step S306, the vibration hardly occurs in the cassette 200 because the stage 111 is intermittently moved during the printing operation. Therefore, it is unnecessary to stop the movement of the stage 111 for the predetermined time period before the second printing process is executed.

When the second printing process is terminated, the cassette 200 is located at the waiting position. Hence, after the second printing is terminated, the cassette 200 is moved to the attaching-detaching position.

The embodiments described above use fabric such as a T-shirt as the cloth 400. Alternatively, the embodiments described above are applicable to media including fabric on which an image is printed and heated. In this case, the cloth 400 used in the embodiments described above serves as a medium.

Numerous additional modifications and variations of the present disclosure are possible in light of the above teachings. It is therefore to be understood that within the scope of the appended claims, the present disclosure may be executed otherwise than as specifically described herein. For example, the printer is not limited to the above-described various embodiments and may be altered as appropriate.

What is claimed is:

1. A printer, comprising:

a printing mechanism configured to print on a printing object held by a holder;

a reciprocating mechanism configured to move the holder in a first direction and a second direction opposite to the first direction; and controller circuitry configured to control the printing mechanism and the reciprocating mechanism, such that when the controller circuitry executes a superimposed printing on the printing object, the controller circuitry is configured to cause the printing mechanism to execute a pre-printing process and a post-printing process, which prints on an image printed by the pre-printing process, and cause the reciprocating mechanism to stop movement of the holder for a predetermined time period after the pre-printing process is terminated and the holder has returned to a waiting position.

2. The printer according to claim 1, further comprising a receiver to which the holder is detachably attached, wherein the reciprocating mechanism is configured to move the receiver in the first direction and the second direction.

3. The printer according to claim 2, wherein the waiting position and an attaching-detaching position are in opposite positions in the directions in which the holder reciprocates, wherein the attaching-detaching position is a position at which the holder is attached to the receiver or detached from the receiver, and the controller circuitry is further configured to cause the printing mechanism to execute a printing operation after the holder attached to the receiver is moved from the attaching-detaching position to the waiting position.

4. The printer according to claim 2, further comprising a holder mount sensor to detect whether the holder is mounted on the receiver, wherein after the pre-printing process is terminated, when a state in which the holder mount sensor detects the holder persists, the controller circuitry is further configured to cause the printing mechanism to execute the post-printing process, and when the state in which the holder mount sensor detects the holder does not persist, the controller circuitry is further configured not to cause the printing mechanism to execute the post-printing process.

5. The printer according to claim 1, wherein print data for the pre-printing process and print data for the post-printing process are a same print data.

6. The printer according to claim 1, wherein print data for the pre-printing process and print data for the post-printing process are different print data.

7. The printer according to claim 1, wherein the printing object is a cloth.

8. An image applying apparatus, comprising:

the printer according to claim 7;

the holder configured to hold the cloth; and a heating device configured to heat the cloth, wherein the holder is used by both the printer and the heating device, with the cloth held on the holder.

9. A printer, comprising:

a printing mechanism configured to print on a printing object held by a holder;

a reciprocating mechanism configured to move the holder in a first direction and a second direction opposite to the first direction; and controller circuitry configured to control the printing mechanism and the reciprocating mechanism, such that when the controller circuitry executes a superimposed printing on the printing object, the controller circuitry is configured to cause the printing mechanism to execute a pre-printing process, and cause the printing mechanism to execute a post-printing process that prints on an image printed by the pre-printing process.

10. The printer according to claim 9, wherein the printing object is a cloth.

11. An image applying apparatus, comprising:

the printer according to claim 10;

the holder configured to hold the cloth; and a heating device configured to heat the cloth, wherein the holder is used by both the printer and the heating device, with the cloth held on the holder.

12. A method of printing, comprising:

attaching a holder holding a printing object to a receiver in a printer;

executing a pre-printing process after the receiver has been moved to a waiting position opposite to an attaching-detaching position at which the holder is attached to the receiver or detached from the receiver;

stopping a movement of the receiver for a predetermined time period at the waiting position after the pre-printing is terminated and the receiver has returned to the waiting position; and executing a post-printing process that prints on an image printed by the pre-printing process, after the predetermined time period has elapsed.

* * * * *